US005700185A

United States Patent [19]

Halonie

[11] Patent Number: 5,700,185

[45] Date of Patent: Dec. 23, 1997

[54] PIN VISE

[76] Inventor: Dean Halonie, 5435 Austin Lake Rd., Webster, Wis. 54893

[21] Appl. No.: 689,598

[22] Filed: Aug. 12, 1996

[51] Int. Cl.[6] ..... B25B 5/04

[52] U.S. Cl. ..... 451/365; 269/902; 269/236

[58] Field of Search ..... 451/365; 269/296, 269/297, 902, 303, 309, 236, 237, 238

[56] References Cited

U.S. PATENT DOCUMENTS 3,345,061 10/1967 Schaefer ..... 269/902

5,172,896 12/1992 Beere ..... 269/902

5,358,228 10/1994 Beere ..... 269/902

*Primary Examiner*—Eileen P. Morgan

[57] ABSTRACT

A new Pin Vise for removably retaining various sizes of pins for grinding to a specified length which allows the user to easily load and unload the pin for increased productivity. The inventive device includes a base member, a support shaft secured to the base member orthogonally, a top member secured to the support shaft opposite of the base member, and a spring loaded pin retaining means slidably secured to the top member which retains the pin against the top member thereby allowing grinding to the specified length.

11 Claims, 3 Drawing Sheets

FIG. 3
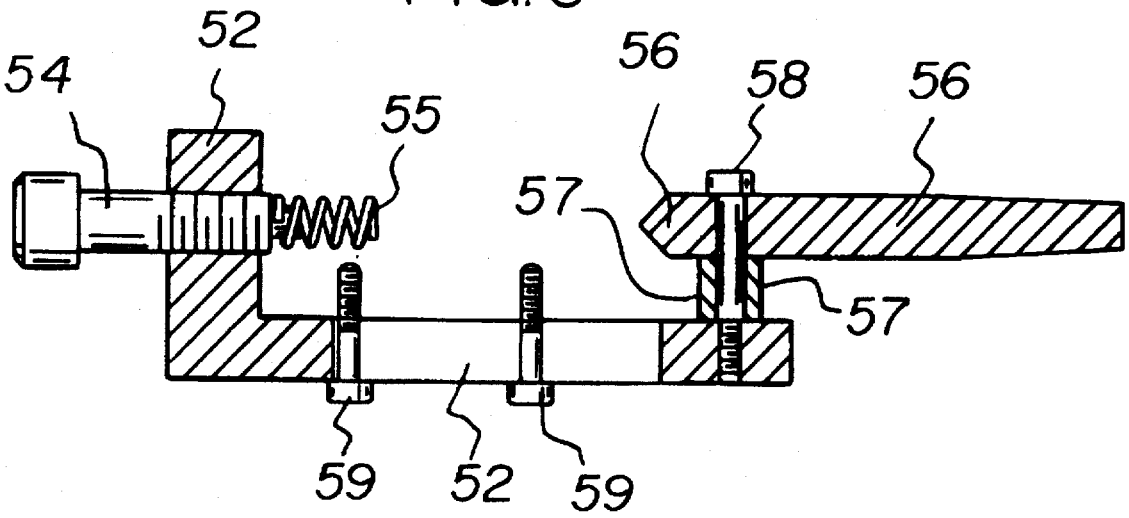
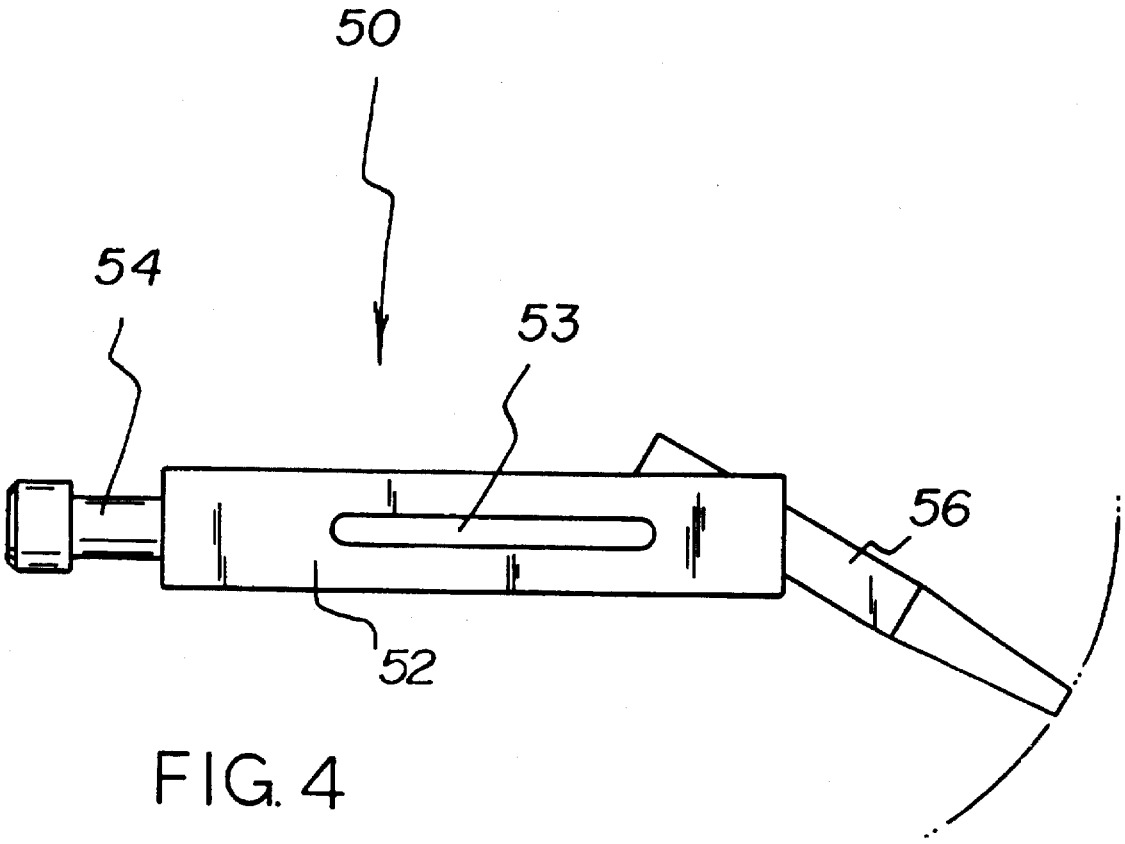
FIG. 4

PIN VISE

BACKGROUND OF THE INVENTION

1. Field of the Invention

The present invention relates to Vise Devices and more particularly pertains to a new Pin Vise for removably retaining various sizes of pins for grinding to a specified length which allows the user to easily load and unload the pin for increased productivity.

2. Description of the Prior Art

The use of Vise Devices is known in the prior art. More specifically, Vise Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Vise Devices include U.S. Pat. No. 3,862,516; U.S. Pat. No. 4,691,903; U.S. Design Pat. No. 262,599; U.S. Pat. No. 4,790,073; U.S. Pat. No. 5,160,335 and U.S. Pat. No. 3,918,727.

While these devices fulfill their respective, particular objectives and requirements, the aforementioned patents do not disclose a new Pin Vise. The inventive device includes a base member, a support shaft secured to the base member orthogonally, a top member secured to the support shaft opposite of the base member, and a spring loaded pin retaining means slidably secured to the top member which retains the pin against the top member thereby allowing grinding to the specified length.

In these respects, the Pin Vise according to the present invention substantially departs from the conventional concepts and designs of the prior art, and in so doing provides an apparatus primarily developed for the purpose of removably retaining various sizes of pins for grinding to a specified length which allows the user to easily load and unload the pin for increased productivity.

SUMMARY OF THE INVENTION

In view of the foregoing disadvantages inherent in the known types of Vise Devices now present in the prior art, the present invention provides a new Pin Vise construction wherein the same can be utilized for, removably retaining various sizes of pins for grinding to a specified length which allows the user to easily load and unload the pin for increased productivity.

The general purpose of the present invention, which will be described subsequently in greater detail, is to provide a new Pin Vise apparatus and method which has many of the advantages of the Vise Devices mentioned heretofore and many novel features that result in a new Pin Vise which is not anticipated, rendered obvious, suggested, or even implied by any of the prior art Vise Devices, either alone or in any combination thereof.

To attain this, the present invention generally comprises a base member, a support shaft secured to the base member orthogonally, a top member secured to the support shaft opposite of the base member, and a spring loaded pin retaining means slidably secured to the top member which retains the pin against the top member thereby allowing grinding to the specified length.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Pin Vise apparatus and method which has many of the advantages of the Vise Devices mentioned heretofore and many novel features that result in a new Pin Vise which is not anticipated, rendered obvious, suggested, or even implied by any of the prior art Vise Devices, either alone or in any combination thereof.

It is another object of the present invention to provide a new Pin Vise which may be easily and efficiently manufactured and marketed.

It is a further object of the present invention to provide a new Pin Vise which is of a durable and reliable construction.

An even further object of the present invention is to provide a new Pin Vise which is susceptible of a low cost of manufacture with regard to both materials and labor, and which accordingly is then susceptible of low prices of sale to the consuming public, thereby making such Pin Vise economically available to the buying public.

Still yet another object of the present invention is to provide a new Pin Vise which provides in the apparatuses and methods of the prior art some of the advantages thereof, while simultaneously overcoming some of the disadvantages normally associated therewith.

Still another object of the present invention is to provide a new Pin Vise for removably retaining various sizes of pins for grinding to a specified length which allows the user to easily load and unload the pin for increased productivity.

Yet another object of the present invention is to provide a new Pin Vise which includes a base member, a support shaft secured to the base member orthogonally, a top member secured to the support shaft opposite of the base member, and a spring loaded pin retaining means slidably secured to the top member which retains the pin against the top member thereby allowing grinding to the specified length.

Still yet another object of the present invention is to provide a new Pin Vise that is easier to utilize and far more durable than conventional vises.

Even still another object of the present invention is to provide a new Pin Vise that is spring loaded to receive various sizes of pins which also allows repeatability and adjustability.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 1.

FIG. 4 is a right side view of the spring loaded pin retaining means.

DESCRIPTION OF THE PREFERRED EMBODIMENT

Figure 1:
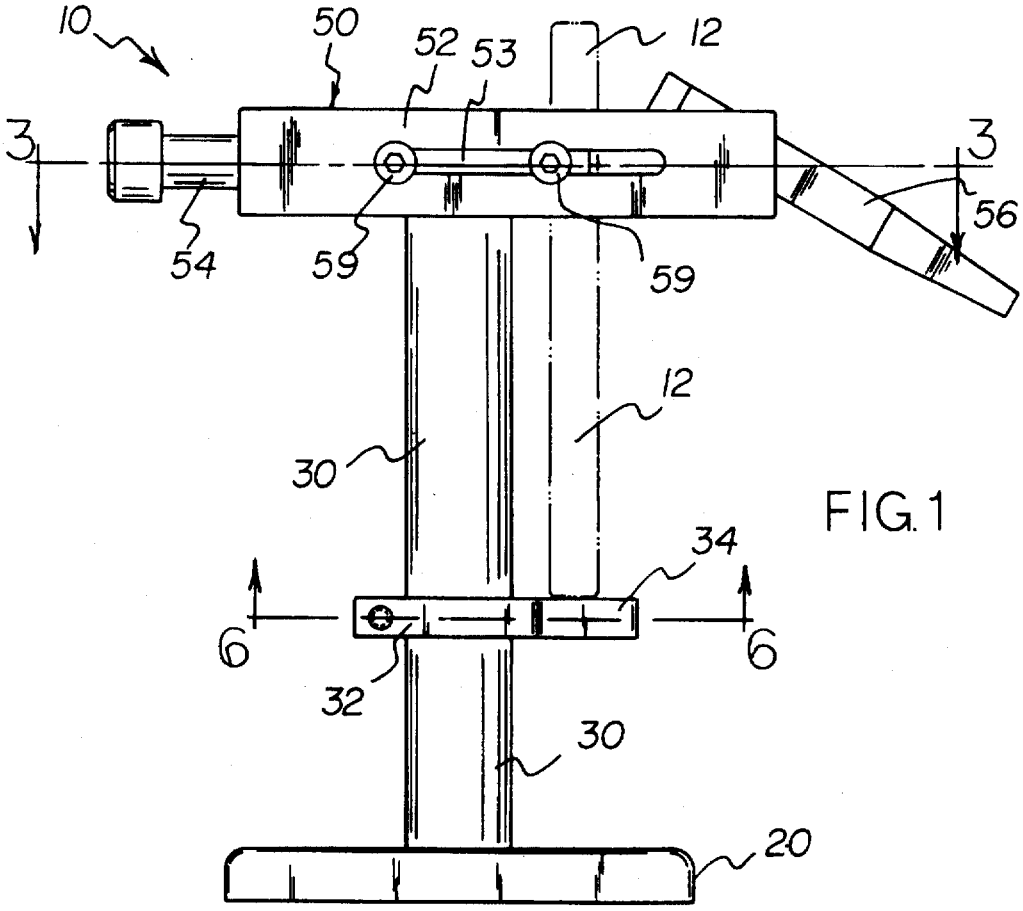
FIG. 1 is a right side view of a new Pin Vise according to the present invention.

With reference now to the drawings, and in particular to FIGS. 1 through 6 thereof, a new Pin Vise embodying the principles and concepts of the present invention and generally designated by the reference numeral 10 will be described.

More specifically, it will be noted that the Pin Vise 10 comprises a base member 20, a support shaft 30 secured to the cornice of the base member 20 at one end and projecting orthogonally to the base member 20, a top member 40 secured to the end of the support shaft 30 opposite of the base member 20 and parallel to the base member 20, where the top member 40 includes a cylindrical spring recess 44 at one end and a syncline notch 42 at the opposite end, and a spring loaded pin retaining means 50 slidably secured to the top member 40 thereby removably retaining various sizes of pins 12 mesial it and the top member 40 for grinding to a specified length.

Figure 2:
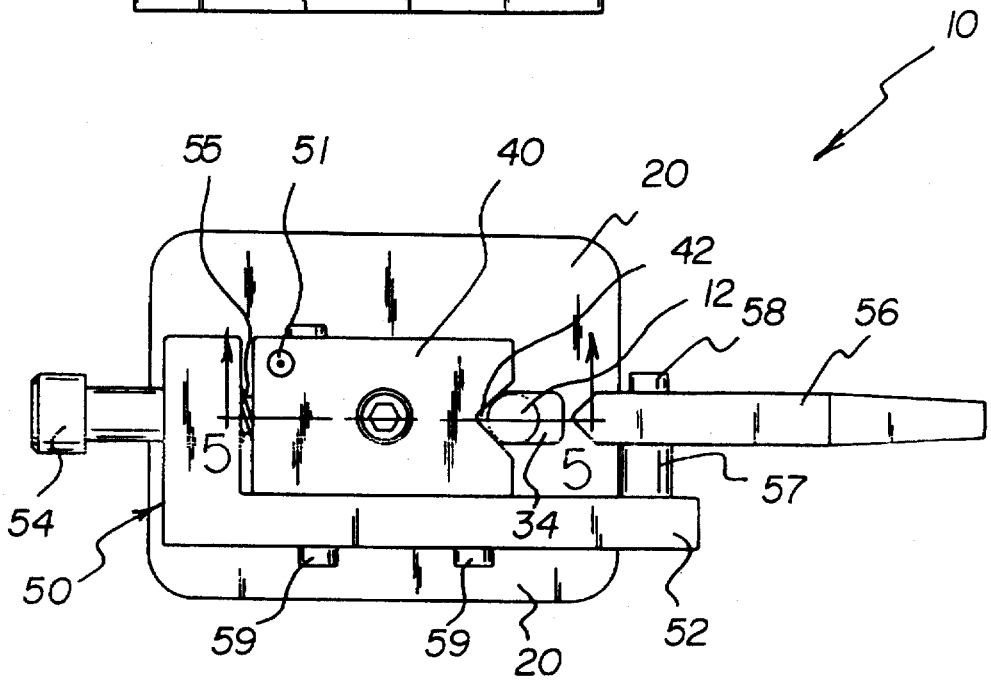
FIG. 2 is a top a view thereof.
Figure 5:
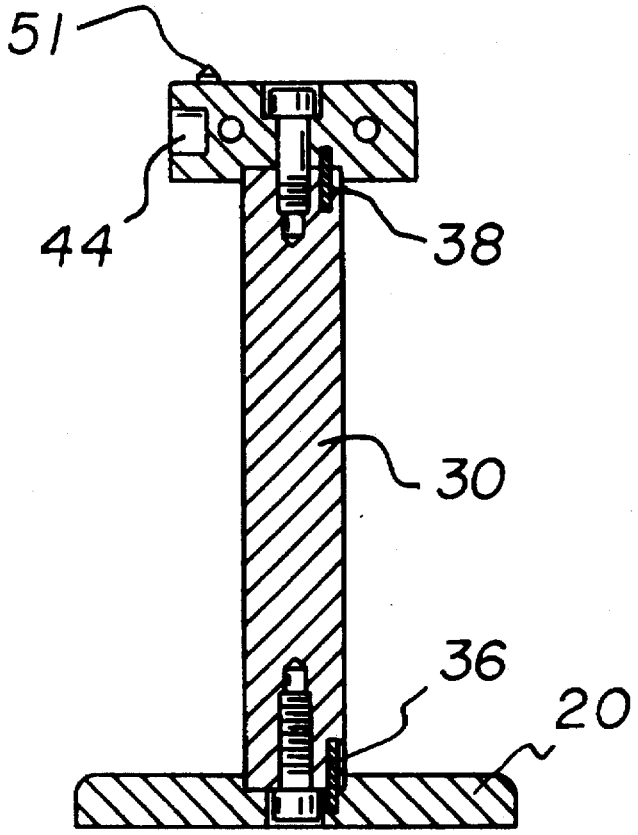
FIG. 5 is a cross sectional view taken along line 5—5 of FIG. 2.
Figure 6:
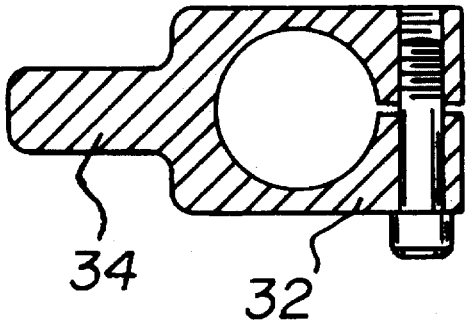
FIG. 6 is a cross sectional view taken along line 6—6 of FIG. 1

As best illustrated in FIGS. 1 through 4, it can be shown that the spring loaded pin retaining means 50 includes an L-shaped member 52 including an aligning slot 53 along the lengthened side. There at least two aligning bolt 59s project slidably through the aligning slot 53 then secured to the top member 40 allowing the L-shaped member 52 to slide on a horizontal plane. The L-shaped member 52 includes an adjusting bolt 54 threadably engaging the end adjacent to the aligning slot 53 parallel to the aligning slot 53. The adjusting bolt 54 projects slidably through a compression spring 55 which is mesial within the spring recess 44 and the adjusting bolt 54, providing force to separate the L-shaped member 52 and the top member 40 as best disclosed in FIGS. 2 and 3 of the drawings. As best shown in FIG. 2 of the drawings, a first bolt 58 projects through a cantilever 56, then through a bushing 57, then secured to the end of the L-shaped member 52 opposite of the adjusting bolt 54 and projecting orthogonally to the longitudinal axis of said adjusting bolt 54. The cantilever 56 is pivotally secured to the first bolt 58. The cantilever's 56 end nearest the top member 40 is formed into a syncline shape which corresponds to and is received by the syncline notch 42 of the top member 40 as best shown in FIG. 2. The pin 12 is removably received mesial the syncline notch 42 and the end of the cantilever 56 syncline shaped. The top member 40 includes a diamond point 51 on the cornice for dressing the surface grinder wheel. A cuff 32 slidably surrounds the support shaft 30 mesial the base member 20 and the top member 40 as shown in FIG. 1 of the drawings. The cuff 32 is locked into position by an unnumbered tightening bolt. A support member 34 is secured to the cuff 32 opposite of the tightening bolt and projecting parallel to the top member 40 as shown in FIG. 1 and 6 of the drawings. The support member 34 supports the bottom end of the pin 12 thereby preventing said pin 12 from descending during grinding to the proper length. The top member 40 and the base member 20 are preferably each secured to the support shaft 30 by an unnumbered threaded bolt centrally positioned as shown in FIG. 5 of the drawings. A bottom dowel 36 is preferably secured within the base member 20 and the support shaft 30 thereby preventing rotation as shown in FIG. 5 of the drawings. A top dowel 38 is secured within the top member 40 and the support shaft 30 thereby preventing rotation. The components are preferably constructed from hardened steel.

In use, the user pulls down the end of the cantilever 56 opposite of the end which is syncline shaped. The user then positions the upper portion of the pin 12 within the syncline notch 42 and the bottom end juxtaposed to the cornice of the support member 34. The user then pivots the cantilever 56 so the longitudinal axis of the cantilever 56 is parallel to the base member 20 and where the syncline shaped end is juxtaposed to the pin 12 thereby retaining said pin 12 mesial the cantilever 56 and the top member 40. The compression spring 55 pulls the cantilever 56 towards the pin 12 so as to retain said pin 12 for grinding. The user grinds the pin 12 until the proper length has been achieved. Thereafter, the user then pivots the cantilever 56 to release the pin 12 from the present invention. The user removes the pin 12 and repeats the above procedure for a plurality of other pins 12 of various sizes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Pin Vise comprising a base member;

a support shaft having one end secured to the base member;

a top member secured to the support shaft above the base member in a substantially parallel relationship to the base member, said top member having a cylindrical spring recess at one end of the top member and a substantially V-shaped notch at the opposite end of said top member; and a spring-loaded pin retaining means slidably secured to the top member for removably retaining various sizes of pins between said pin retaining means and the top member for grinding to a specified length, wherein the spring-loaded pin retaining means includes an L-shaped member having a longer leg and a shorter leg, said L-shaped member having an aligning slot in the longer leg; and at least two aligning bolts slidably projecting through the aligning slot of said L-shaped member and being secured to the top member to permit the L-shaped member to slide in the plane of the cylidical spacing recess and the V-shaped notch of said top member.

2. The Pin Vise of claim 1, wherein the L-shaped member includes an adjusting bolt threadably mounted in a threaded aperture extending through the shorter leg of said L-shaped member such that the adjusting bolt projects out of said L-shaped member in alignment with the cylindrical spring recess of said top member to abut against said top member, and a compression spring positioned between the shorter leg of said L-shaped member and the cylindrical spring recess of said top member and having said adjusting bolt extending through the center of said compression spring to bias the shorter leg of said L-shaped member away from said top member.

3. The Pin Vise of claim 2 additionally comprising a cantilever arm pivotally mounted to the end of the longer arm of said L-shaped member, said cantilever arm being substantially aligned with the V-shaped notch of said top member.

4. The Pin Vise of claim 3, wherein the cantilever arm has a V-shaped end aligned with the V-shaped notch of the top member such that a pin may be removably received between the V-shaped notch and the V-shaped end of the cantilever arm.

5. The Pin Vise of claim 1, wherein the top member includes a diamond point mounted therein.

6. The Pin Vise of claim 1, additionally comprising a support cuff slidably mounted on the support shaft between the base member and the top member.

7. The Pin Vise of claim 6, additionally comprising a support member secured to the cuff in an orientation parallel to the top member for supporting the bottom end of the pin positioned between said top member and said cantilever arm.

8. The Pin Vise of claim 1 wherein the top member and the base member are each secured to the support shaft by a threaded bolt.

9. The Pin Vise of claim 1 additionally comprising a bottom dowel secured within the base member and the support shaft to prevent rotation of said support shaft with respect to said base member.

10. The Pin Vise of claim 1 additionally comprising a top dowel secured within the top member and the support shaft to prevent rotation of said top member with respect to said support shaft.

11. The Pin Vise of claim 10, wherein said base member, said support shaft, said top member and said cantilever arm are constructed from hardened steel.

* * * * *